US008516722B2

(12) United States Patent
Walker

(10) Patent No.: US 8,516,722 B2
(45) **Date of Patent: *Aug. 27, 2013**

(54) SHOE TONGUE CENTRALIZER

(76) Inventor: James Clair Walker, Reno, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/452,002

(22) Filed: Apr. 20, 2012

(65) Prior Publication Data

US 2012/0246844 A1 Oct. 4, 2012

Related U.S. Application Data

(63) Continuation of application No. 12/589,659, filed on Oct. 27, 2009, now Pat. No. 8,166,675.

(51) Int. Cl.
*A43B 5/12* (2006.01)
*A43B 23/26* (2006.01)

(52) U.S. Cl.
USPC ..... 36/50.1; 36/54

(58) Field of Classification Search
USPC ..... 36/136, 50.1, 50.5, 54
See application file for complete search history.

(56) References Cited

U.S. PATENT DOCUMENTS

| | | | | | |
|---|---|---|---|---|---|
| 268,994 | A | * | 12/1882 | Bray | 450/142 |
| 484,381 | A | * | 10/1892 | Watson | 24/712.2 |
| 1,348,392 | A | * | 8/1920 | Cook | 36/50.1 |
| 1,689,000 | A | * | 10/1928 | Wagner | 36/50.1 |
| 4,545,138 | A | | 10/1985 | Blum | |
| 6,438,871 | B1 | | 8/2002 | Culverwell | |
| 7,062,867 | B2 | | 6/2006 | Meibock | |
| 8,166,675 | B2 | * | 5/2012 | Walker | 36/50.1 |
| 2007/0227045 | A1 | | 10/2007 | Aveni et al. | |

* cited by examiner

*Primary Examiner* — Marie Patterson
(74) *Attorney, Agent, or Firm* — Fish & Richardson P.C.

(57) ABSTRACT

The shoe tongue centralizer assembly includes a binding post and a centralizer band which, together prevent the tongue of any type of laced shoe, boot or other footwear from significant movement either laterally or longitudinally in the footwear.

12 Claims, 3 Drawing Sheets

SHOE TONGUE CENTRALIZER

CROSS REFERENCE TO RELATED APPLICATIONS

This is a continuation of U.S. application Ser. No. 12/589,659 filed on Oct. 27, 2009 by James C. Walker. The content of this prior application is fully incorporated herein by reference.

BACKGROUND

This intent of this invention is to provide an improved method of maintaining the free end of the tongue of a shoe, boot, skate or other type of laced footwear (collectively referred to herein as shoe) that utilizes a tongue, centered between the upper ends of the two vamps. In the conventional shoe, the tongue is attached to the lower part of the vamp, leaving the upper end of the tongue to move freely. Due to the shape of the foot, the tendency of the upper portion of the tongue is to drift outward and sometimes downward, causing discomfort and an esthetically unappealing visual projection of the shoe. Other attempts at securing the tongue from lateral or longitudinal movement include slits in the tongue for the laces to pass through, which limit, but not prevent, movement and other mechanical devices to secure the tongue to the vamps or laces. These methods proved to be either inadequate, or inconvenient in the normal process of manufacturing and or putting on, wearing or taking off the shoe.

SUMMARY

The Shoe Tongue Centralizer assembly maintains the shoe tongue in the center of the opening between the two upper vamps while inserting the foot into the shoe and while the shoe is being worn. The Shoe Tongue Centralizer allows movement of the tongue as a result of movement of the foot while the shoe is being worn, yet maintains the relative centralization of the tongue in relation to the vamps.

In the present assembly, the shoe includes the conventional sole, side quarters, vamps and tongue and a centralizer assembly for maintaining the tongue in the center of the vamps. The centralizer assembly secures the tongue to the right and left upper vamps by means of an elastic centralizer band anchored in upper eyelets and a binding post mounted to the center of the upper portion of the tongue.

DETAILED DESCRIPTION

Figure 1:
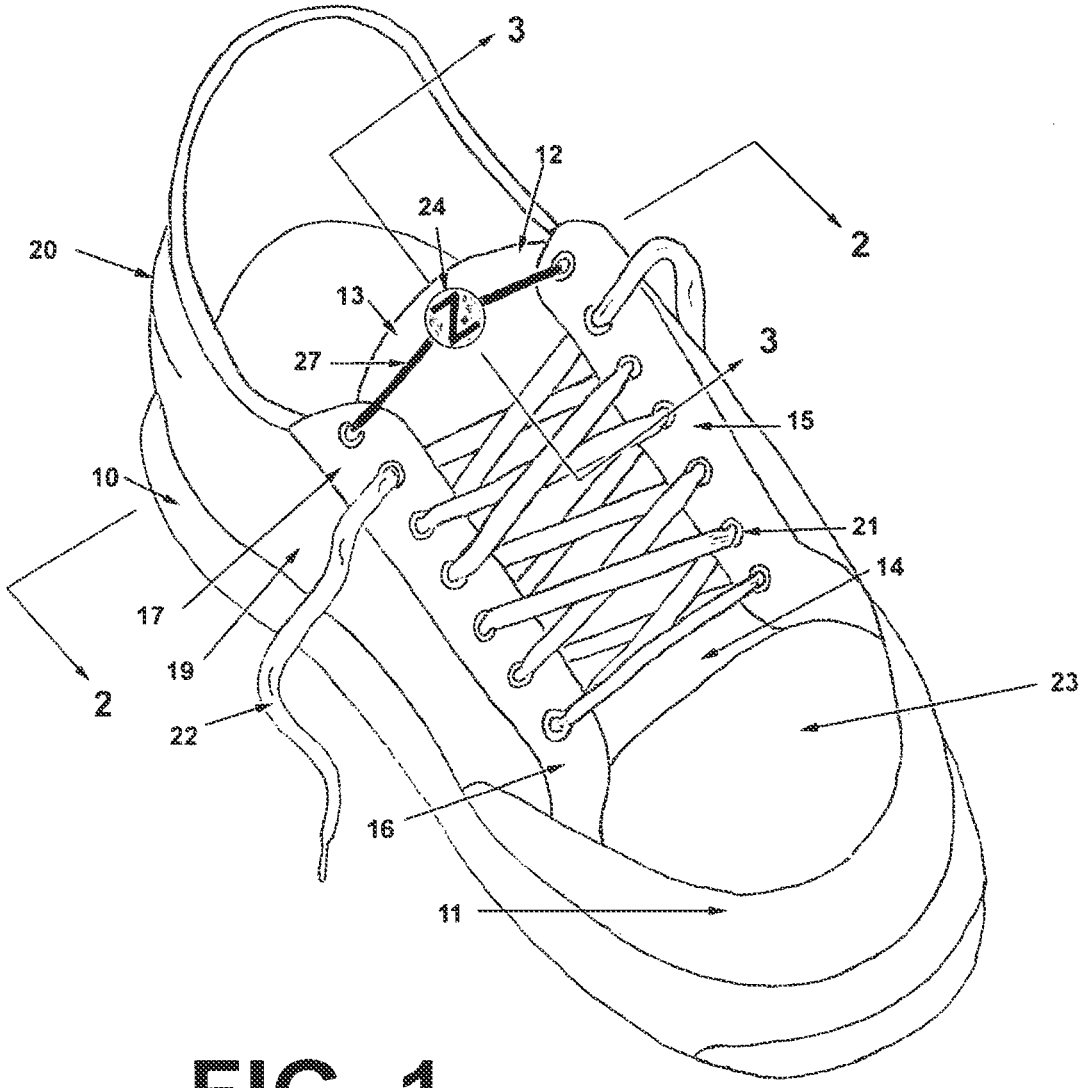
FIG. 1 is an isometric view of one shoe type utilizing the Shoe Tongue Centralizer Assembly.

Although there are many possible embodiments of this invention, specific embodiments are shown in the drawings and will be described herein. The embodiments described are to be considered an example of the concepts of the invention and not intended to limit the invention to the embodiments as described herein and depicted in the figures. The shoe tongue shown in the Figures generally is representative of the type of tongue in an athletic or "tennis" shoe. However, the invention can be used in all types of footwear, including ice and roller skates, hiking boots and virtually all types of laced footwear where the tongue is anchored at the vamp.

There are several advantages of the present invention. The first advantage is to keep the shoe tongue centered in the opening between the upper vamp ends. For any lace type of footwear, the central function of the shoe tongue is to provide a buffer between the foot and laces. The tongue on many types of shoe, tends to free float and move outward, or to the right on the right foot and to the left on the left foot. The shifting of the tongue can cause discomfort and even medical maladies for the wearer. The second advantage is apparent when the tongue is severely out of position. In this instance, the tongue will no longer protect the wearer from the laces contacting the upper portion of the foot. The third advantage of the tongue being centered is the aesthetic appeal. Finally, the surface of the binding post allows for the display of an endless number of symbols, logos or other decorative display.

Figure 2:
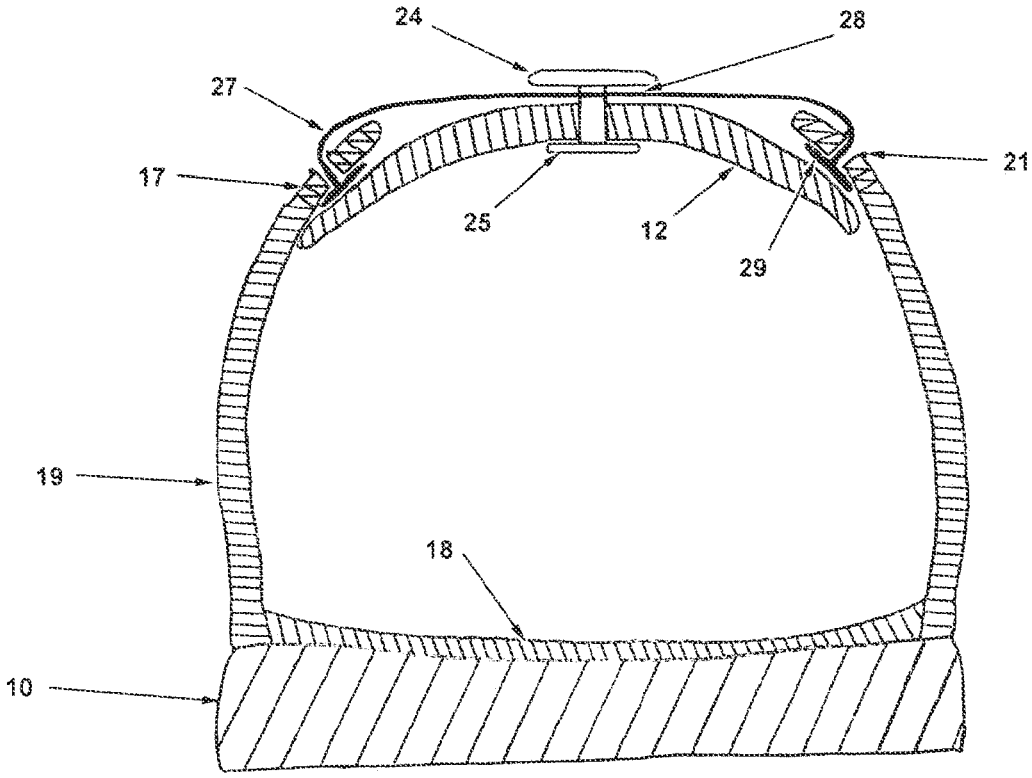
FIG. 2 is a cross section of the shoe depicted in FIG. 1 utilizing the Shoe Tongue Centralizer Assembly, showing the Binding Post and Elastic Centralizer Band.
Figure 3:
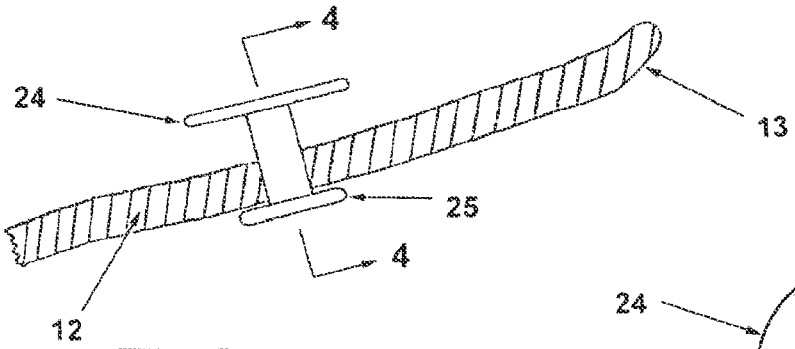
FIG. 3 is an enlarged cross section of a shoe tongue, showing the penetration of the Binding Post through the tongue material.

FIG. 1 shows one embodiment of the invention on an athletic shoe. The shoe has side quarters 19 and Front Toe 11 attached to sole 10. Vamp 15 is attached to the side quarters 19, with eyelets 21 attached to vamp 15. Laces 22 are threaded through eyelets 21 for securing the shoe to the wearer's foot. The embodiment illustrated in FIG. 1 shows binding post top 24 and elastic centralizer band 27. FIG. 2 shows the binding post top 24 secured to binding post bottom 25, which penetrate tongue upper end 13 and pass through elastic centralizer band loop 28. Elastic centralizer band 27 is secured to Vamp Upper End 17 by elastic centralizer band anchors 29 which pass through the uppermost eyelets 21. FIG. 3 shows a cross section of tongue 12 with the binding post top 24 penetrating the tongue upper end 13 and threaded into binding post bottom 25.

Figure 5:
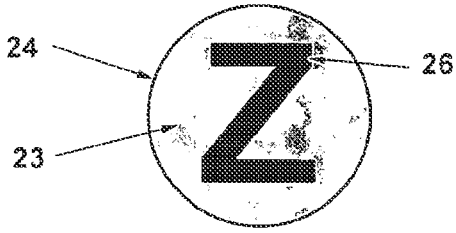
FIG. 5 is an enlarged view of the Binding Post top surface showing a possible decorative emblem.
Figure 4:
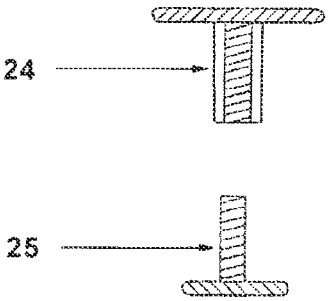
FIG. 4 is an enlarged cross section of a Binding Post showing one method of fastening the top part of the Binding Post to the bottom part of the Binding Post.

The binding post top 24 can have a smooth plain surface, or a logo or emblem 26 on the surface as show in FIG. 5. The binding post top 24 is secured to the binding post bottom 25 by a male threaded post on the binding post bottom 25 that threads into the female threaded binding post top 24 as shown in FIG. 4. This allows the end user to change the binding post should a different logo be desired.

Figure 6:
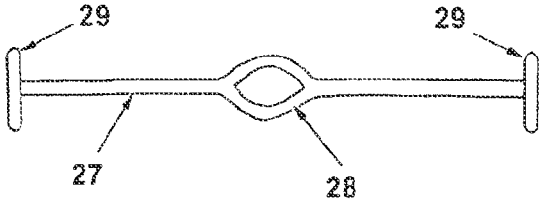
FIG. 6 is an enlarged view of one type of elastic centralizer band showing the binding post loop and end anchors.

FIG. 6 show the elastic centralizer band 27, which will be available in various lengths to accommodate various shoe sizes and tightness levels for the end user. For a given shoe size, longer bands 27 will allow more flexibility. The end user will be able to easily change bands by slipping the elastic centralizer band loop 28 over the binding post top 24 and slipping elastic centralizer band anchors 29 out of eyelets 21. Elastic centralizer bands 27 will also be available in multiple colors, so that the end user can customize their shoes.

Figure 7:
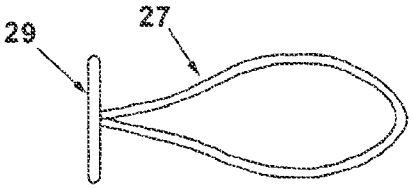
FIG. 7 is an enlarged view of a second embodiment of elastic centralizer band showing a single end anchor with both ends of the elastic band secured to the end anchor. In this embodiment, two centralizer bands would be used on each shoe.

A second embodiment of the elastic centralizer band 27 is shown in FIG. 7. This embodiment forms the elastic centralizer band loop by attaching the two ends of the elastic centralizer band 27 to one end anchor 29. In this embodiment, two elastic centralizer bands assemblies will be used on each shoe.

What is claimed is:

1. A method of using shoe tongue centralizer assembly, comprising:

positioning a shoe tongue between two vamps of a shoe;

penetrating a binding post device through the shoe tongue, the binding post device including a top portion that is detachable from a lower portion, at least one of the top portion and lower portion of the binding post device including a shaft member to extend at least partially through the tongue, the top portion of the binding posting include a generally flat member that extends generally perpendicularly relative to the shaft member and is disposed over an upper surface of the tongue when the binding post is penetrated through the tongue; and engaging an elastically flexible band device with the binding post device and releasably securing said elastically flexible band device to each of the two vamps of the shoe, wherein the elastically flexible band device engages the binding post device so as to bias the tongue of the shoe toward a central position between the two vamps.

2. The method of claim 1, further comprising threadably engaging the top portion of the binding post device with the lower portion of the binding post device.

3. The method of claim 2, wherein the top portion of the binding post device includes the shaft member, and the lower portion of binding post device includes a lower shaft member that threadably engages the shaft member of the top portion.

4. The method of claim 3, wherein the shaft member of the top portion of the binding post device comprises a female threaded shaft that mates with corresponding male threads of the lower shaft member of the lower portion.

5. The method of claim 2, further comprising displaying a decorative display provided by the generally flat member of the top portion of the binding post device that is opposite from the tongue of the shoe.

6. The method of claim 1, wherein penetrating the binding post device through the shoe tongue comprises penetrating the binding post device through an upper portion of the tongue of the shoe.

7. The method of claim 1, wherein the elastically flexible band device comprises a first free end portion releasably secure to a first of the two vamps, a second free end portion releasably secured to a second of the two vamps, and a loop defining an aperture arranged generally centrally between the first and second free end portions.

8. The method of claim 7, wherein the loop slidably engages with the shaft member of the binding post device that penetrates through the tongue.

9. The method of claim 8, wherein the loop of the elastically flexible band device releases from the binding post device when the top portion of the binding post device is detached from the lower portion of the bonding post device.

10. The method of claim 7, wherein the elastically flexible band device comprises an elastomeric material.

11. The method of claim 7, wherein the first free end portion of the elastically flexible band device comprises a first anchor structure that is insertable through a first eyelet of the first vamp so as to releasably secure the first free end portion with the first eyelet, and wherein the second free end portion of the elastically flexible band device comprises a second anchor structure that is insertable through a second eyelet of the second vamp so as to releasably secure the second free end portion with the second eyelet.

12. The method of claim 1, wherein the elastically flexible band device comprises two elastomeric bands that each form a loop, each of the two elastomeric bands being coupled to a respective anchor member.

* * * * *